US005490529A

United States Patent [19]

Fitjer

[11] Patent Number: 5,490,529

[45] Date of Patent: Feb. 13, 1996

[54] BRUSH WITH BRISTLES FIXED BETWEEN TWISTED SEGMENTS OF WIRE

[75] Inventor: Holger Fitjer, Ansbach, Germany

[73] Assignee: Georg Karl Geka-Brush GmbH, Bechhofen-Waizendorf, Germany

[21] Appl. No.: 182,557

[22] Filed: Jan. 18, 1994

[30] Foreign Application Priority Data

Feb. 27, 1993 [DE] Germany ..... 43 06 214.8

[51] Int. Cl.[6] ..... A45D 40/26

[52] U.S. Cl. ..... 132/218; 132/162; 15/206

[58] Field of Search ..... 132/120, 218, 132/216, 162, 227; 15/206, 114, 160, 167.1, 164.94, 104.93

[56] References Cited

U.S. PATENT DOCUMENTS

| | | | |
|---|---|---|---|
| 1,337,819 | 4/1920 | Braun | 15/206 |
| 2,303,660 | 12/1942 | Schnickel | 15/114 |
| 4,341,231 | 7/1982 | Costa | 132/218 |
| 4,365,642 | 12/1982 | Costa | 132/218 |
| 4,395,943 | 8/1983 | Brandli | 15/167 |
| 4,856,541 | 8/1989 | Kellett et al. | 132/110 |

FOREIGN PATENT DOCUMENTS

| | | | |
|---|---|---|---|
| 409462 | 5/1934 | United Kingdom | 15/206 |

*Primary Examiner*—John G. Weiss
*Attorney, Agent, or Firm*—Browdy and Neimark

[57] ABSTRACT

In a mascara brush, with a plurality of bristles fixed in place between two twisted wire segments and extending to all sides away from these twisted wire segments, the wire segments being surrounded by a plastic coating, it is provided, for the purpose of achieving increased liquid absorbing capacity, that the plastic coating consists of a fluid absorbent, in particular open-cell, foamed material.

It may further be provided that the foamed coating is roughened or fringed to such an extent that the bristles are formed by this roughening or fringing.

9 Claims, 1 Drawing Sheet

FIG. 1
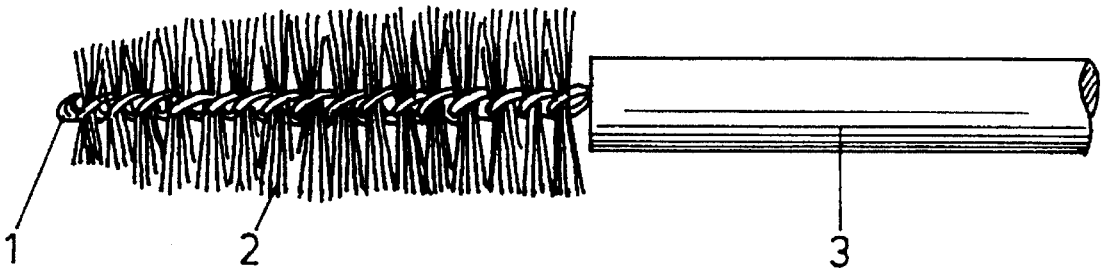
FIG. 2
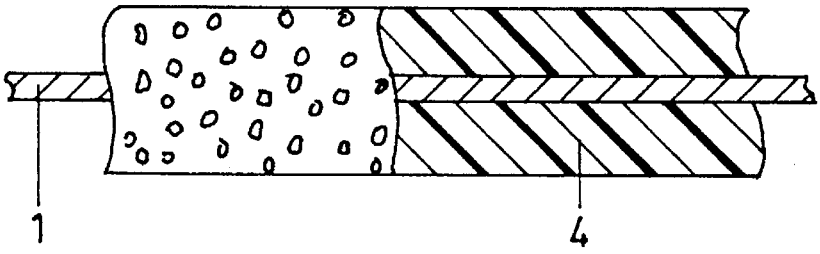
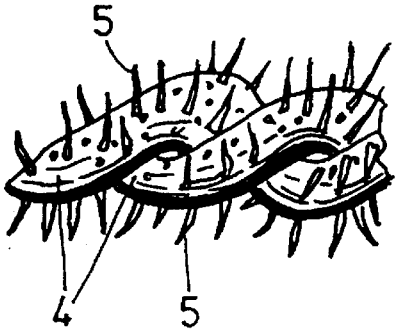
FIG. 3

BRUSH WITH BRISTLES FIXED BETWEEN TWISTED SEGMENTS OF WIRE

BACKGROUND OF THE INVENTION

1. Field of the Invention

The invention relates to a brush, in particular a mascara brush, dental brush and medical cleaning and applicator brush, a plurality of bristles being fixed in place between twisted segments of wire and extending to all sides away from these twisted segments of wire, and the segments of wire being provided with a plastic coating.

2. Background Art

Brushes of the species under regard have been known for lots of years. In their embodiments of minor size they are used for the application of mascara fluid to eyelashes, i.e. in cosmetics, or as dental brushes especially for the cleaning of interdental gaps. Their embodiments of greater size are for instance used for cleaning bottles or pipes.

It has been known for brushes of the generic type, too, to provide the wires with a solid plastic coating prior to their being twisted. For instance, it is known from German patent P 31 28 749 to provide a plastic coating for the wires in interproximal dental brushes so that galvanic contacts of the wire segments with fillings or other sensitive parts of teeth be avoided. As to cleaning brushes, it is further known to sheathe the wires with a closed plastic coating so as to prevent any damages to the objects to be cleaned by bare wire sections. Ultimately, it is known for instance from U.S. Pat. No. 5,161,554 for mascara brushes that the wire segments are provided with a smooth plastic coating in order to discontinue the strict geometry in bristle tip distribution caused by the twisting of the wires and to obtain as uniform as possible a tip distribution over the jacket face.

SUMMARY OF THE INVENTION

As compared with the foregoing, it is the object of the invention, while maintaining any possible individually advantageous properties of brushes of the generic type, to increase the capacity of the brush to store a substance to be applied.

According to the invention, this object is attained in that the wire segments are surrounded by a plastic coating consisting of a liquid absorbing, in particular open-cell, foamed material which is achieved by using a foamed material having a high pore per linear inch count.

While, so far, exclusively plastic sheathings of a closed smooth surface have been used, the use of such a foamed coating results in that the liquid to be applied is not only retained by the bristles of the trimming as a result of the surface tension between adjacent bristles or kept to the individual bristles as a result of their capillary structure, but that even the twisted core of the brush—so far ineffecient in this regard—contributes to storing the substance.

The additional reservoir formed by the twisted foam-coated wire segments may serve to accommodate additional mascara fluid or the like, having a suspension of pigment particles as is conventional in the art but also to store a disinfectant, a detergent or the like.

The wire core, i.e. the twisted segments of metal wire used, may advantageously have a diameter of 0.25 to 2.5 mm, its surface may be smooth or structured to improve the bonding effect on the foamed coating. The cross section of these wire cores may be round—which will be the case as a rule—but it may also be in the form of a polygon.

The foamed coating consists of an absorbent, foamed plastic material, such as PU, PE, PUC, latex, rubber or sponge.

Of course, such brushes offer the possibility to choose the most differing configurations of the tips of the bristles arrested, i.e. a uniform cylindrical jacket face or a conically extending one, but also helical structures or structures of corrugated cross section which may be symmetric as well as asymmetric referred to the longitudinal axis.

As for the material of the wire cores used, stainless steel in the quality of 1.4303 or 4301 or ASI 304305 may for instance be provided. The bristles or fibers used can have a conventional, fully round cross section, but also cross-sections of O-, U-, V- shape or the like of increased capillary effect.

The wall thickness of the foamed coating may range between 0.1 and 1.5 mm, there being the possibility, depending on the intended use, to adjust the hardness of the foamed material to be harder or softer.

In a modification of the basic idea according to the invention it is provided that the twisted wire segments are coated only by a foamed material having a very high pores per linear inch count, (ppi) so that an advantageous application effect can be achieved only by the highly open-cell foamed material without the use of bristles or fibers.

This effect may still be improved in that, as early as during the coating of the wire segments or after the twisting of the coated wire segments, the foamed material is mechanically or chemically roughened to form fibrous fringes.

Such a configuration can for instance be used as a mascara brush.

Further details of the invention will become apparent from the ensuing description of a preferred embodiment taken in conjunction with the drawing.

BRIEF DESCRIPTION OF THE DRAWING

FIG. 1 is a perspective view of a brush according to the invention in the form of a mascara brush, FIG. 2 is a view and a section, respectively, of a wire segment with a coating of foamed material, and FIG. 3 is a view of a wire segment with a strongly fringed coating of foamed material.

DESCRIPTION OF THE PREFERRED EMBODIMENT

A brush shown in FIG. 1 which may for instance serve as a mascara brush comprises two intertwisted wire segments 1, a plurality of bristles 2 being conventionally fixed by the twisting. The free ends of the wire segments 1 are arrested in a handle 3 only shown in part.

Each wire segment 1 has been coated by an open-cell foamed material 4 having a high pores per linear inch count prior to being twisted.

The application of plastic coatings to wires is per se known. To this end, the wire is piloted through an extrusion nozzle for the foamed plastic material together with the latter.

The following parameters are used in an especially advantageous embodiment:

| | |
|---|---|
| Cross section of wire: | 0.72 mm |
| Material of wire: | steel 1.4303 |
| Surface of wire: | smooth, round |
| Material of fibers: | Tynex round, 4 mils, PA 6.12 |
| Foamed material for coating the wire: | PUR foam, 100 ppi |
| Tensile strength of the foamed material: | 34 PSI |
| Specific gravity of the foamed material: | 1.75 LB/Ft |
| Resistance to rupture of the foamed material: | 3.9 LB/inch |
| Extensibility of the foamed material: | 472% |
| ppi count of the foamed material: | 100 ppi |

The foamed material is not reticulated.

The number of bristles or fibers 2 per twist of the wire segments 1 is between 10 and 80.

FIG. 3 shows an embodiment without bristles, in which the foamed coating 4 having a high pores per linear inch count has been roughened or fringed on its surface already during extrusion or by subsequent mechanical or chemical treatment such that radially extending fibers 5 are produced having an effect similar to that of the bristles or fibers 2.

What is claimed is:

1. A mascara brush comprising a plurality of twisted wire segments (1) engaged together, each of the wire segments (1) being surrounded by a plastic coating, wherein the plastic coating consists of a open-cell, foamed material (4) formed with a plurality of pores per linear inch which absorb a liquid having a suspension of pigment particles.

2. A brush according to claim 1, wherein the foamed coating (4) has a wall thickness of between 0.1 and 1.5 mm.

3. A brush according to claim 1, wherein the foamed coating (4) has an elongation property of between 400 and 500%.

4. A brush according to claim 1, wherein the foamed coating (4) has a pores per linear inch count of between 5 and 150.

5. A mascara brush according to claim 1, wherein, during the plastic coating of the wire segments (1) or after the twisting of the coated wire segments (1), the foamed material (4) is mechanically or chemically roughened to form fibrous fringes (5).

6. A mascara brush according to claim 1 wherein a plurality of bristles (2) are fixed between the twisted wire segments (1) and extend to all sides away from the twisted wire segments (1).

7. A mascara brush according to claim 1 wherein the plastic coating is not reticulated.

8. A mascara brush comprising a plurality of twisted wire segments (1) engaged together, each of the wire segments (1) being surrounded by a plastic coating, wherein the plastic coating consists of a open-cell, foamed material (4) formed with a plurality of pores per linear inch which absorb a liquid having a suspension of pigment particles;

wherein the foamed coating (4) has an elongation property of between 400 and 500%.

9. A mascara brush comprising a plurality of twisted wire segments (1) engaged together, each of the wire segments (1) being surrounded by a plastic coating, wherein the plastic coating consists of a open-cell, foamed material (4) formed with a plurality of pores per linear inch which absorb a liquid having a suspension of pigment particles;

wherein the foamed coating (4) has a pores per linear inch count between 5 and 150.

* * * * *